United States Patent [19]

Swarovski et al.

[11] Patent Number: 4,767,676

[45] Date of Patent: Aug. 30, 1988

[54] DECORATIVE BODY MADE OF GLASS

[75] Inventors: Daniel Swarovski; Kurt Schwab, both of Wattens, Austria

[73] Assignee: D. Swarovski & Co., Wattens, Austria

[21] Appl. No.: 918,381

[22] Filed: Oct. 14, 1986

[30] Foreign Application Priority Data

Oct. 11, 1985 [DE] Fed. Rep. of Germany ..... 3536366

[51] Int. Cl.[4] ..... B44F 1/02; B44C 1/28; A47G 35/00; A47G 19/12

[52] U.S. Cl. ..... 428/542.2; D11/158; 156/61; 156/63

[58] Field of Search ..... 428/542.2, 28, 426, 428/35, 36; 362/339; 156/63, 61

[56] References Cited

U.S. PATENT DOCUMENTS

D. 279,774 7/1985 Santa-Eulalia ..... D11/158
967,029 6/1967 Mygatt .

FOREIGN PATENT DOCUMENTS 1929535 2/1965 Fed. Rep. of Germany .

OTHER PUBLICATIONS

Julius Garfinckel & Co., X—mas Catalogs from 1963 and 1965.

*Primary Examiner*—Nancy A. B. Swisher
*Attorney, Agent, or Firm*—Joseph P. Calabrese; Theodore W. Anderson

[57] ABSTRACT

A decorative body made of glass, whose inside is faceted.

10 Claims, 1 Drawing Sheet

FIG. 1
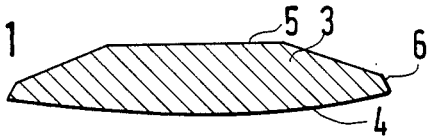
FIG. 2
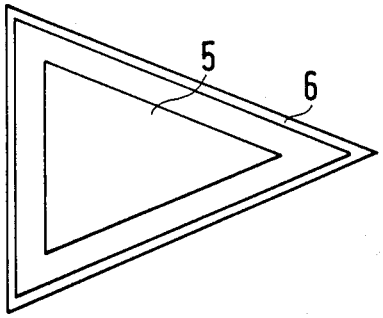
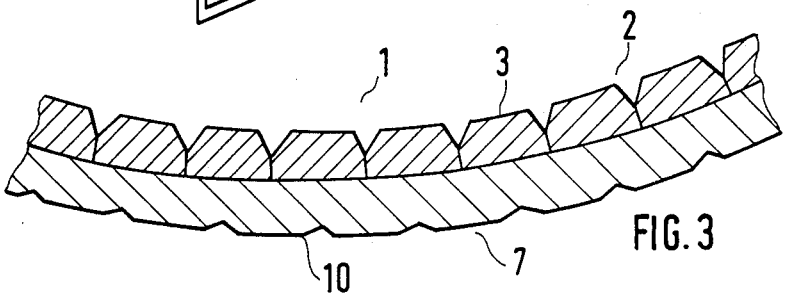
FIG. 3
FIG. 4
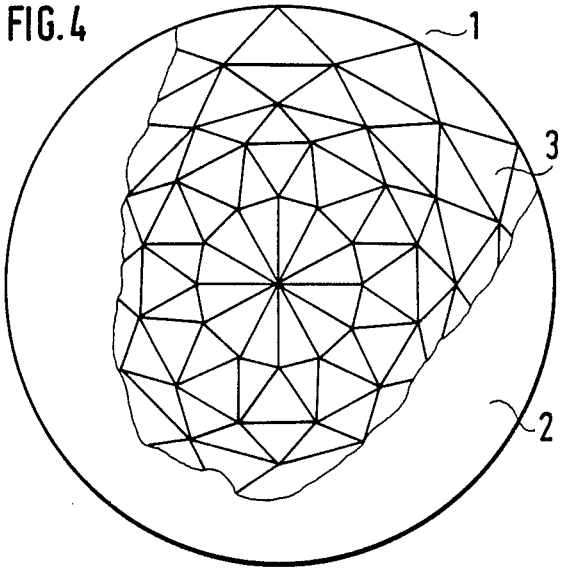

DECORATIVE BODY MADE OF GLASS

The present invention relates to a decorative body made of glass.

Decorative bodies made of glass having a faceted convex outside, such as glasses or bowls, have been known for some time.

However, it is not known to provide decorative bodies made of glass whose concave inside is faceted. This is due to the fact that individual facets cannot be ground and polished optically on a concave surface.

The invention is based on the problem of providing decorative elements characterized by greater luster due to the multiple reflection of light.

The invention is based on the finding that this can be achieved by also faceting the inside of the decorative body made of glass.

The inventive decorative body made of glass is characterized by special luster and thus a special esthetic effect.

The object of the invention is a decorative body made of glass which is characterized in that it has a concave inner surface which is spherical or cylindrical, to which is glued a plurality of decorative elements made of glass which have a spherical or cylindrical underside and a flat or faceted upper side, so that the inside of the decorative body is faceted.

The invention shall be explained in more detail in the following with reference to the drawing, which shows exemplary embodiments.

It shows the following:

FIG. 1 a decorative element in cross-section,

FIG. 2 a decorative element in plan view,

FIG. 3 a decorative body whose concave inside is lined with decorative elements, in cross-section, FIG. 4 a plan view of the decorative body as in FIG. 3.

FIG. 3 shows in cross-section a decorative body 1, for example, a dish. The outside 7 of the decorative body is provided in the known manner with facets 10.

To increase the luster of the decorative body, the concave inner surface 2 is also facetted. This is achieved by arranging a plurality of decorative elements 3 beside each other on the inner surface 2 so that they form a compact inner surface.

The lining of the concave inside 2 of decorative body 1 with the individual decorative elements 3 can be seen well in FIG. 4. The outer contour of decorative elements 3 is that of an equilateral triangle. Triangles can be used particularly well to line spherical surfaces. In particular, equilateral triangular contours are preferred. In addition to triangular contours, tetragonal, pentagonal or hexagonal contours, for example, can also be used.

Concave surfaces are generally more or less exactly spherical surfaces or cylindrical surfaces since only these can be easily ground and polished. However, there are also non-spherical surfaces. In connection with the present invention, "spherical surfaces" also refers to non-spherical surfaces.

Thus, the invention makes it possible for the first time to provide a fully polished body, i.e. a body which is faceted both on the inside and on the outside.

The edge of the decorative body is preferably surface-ground.

An example of a decorative element with a triangular contour is shown in FIGS. 1 and 2.

The underside 4 of decorative element 3 is spherical and conforms with the inside 2 of decorative body 1. Upper side 5 is faceted. Edge 6 is chamfered downwardly on the outside so that the individual decorative elements 3 join together without gaps.

Decorative elements 3 are glued to decorative body 1. Suitable colorless adhesives are known. Foot-fast adhesives are also available, so that the decorative elements can be used, for example, as fruit bows, drinking vessels, etc.

We claim:

1. The combination comprising a decorative body made of glass; said decorative body having a concave inner surface; a plurality of discrete decorative elements secured to said concave inner surface; each of said decorative elements being formed of glass and having a convex underside; each of said decorative elements having a flat or faceted upper side; said decorative elements being arranged on said concave inner surface whereby said decorative body concave inner surface is faceted by means of the upper sides of said decorative elements.

2. The combination of claim 1 on which said decorative body inner surface is spherical and the undersides of the decorative elements are substantially correspondingly spherical.

3. The combination of claim 1 in which said decorative body inner surface is cyylindrical and the undersides of the decorative elements are substantially correspondingly cyclindrical.

4. The combination of claim 1 in which the decorative elements have a triangular or pentagonal outer contour.

5. The combination of claim 1 in which the decorative elements have a perpheral edge which is downwardly chamfered on the outside.

6. The combination of claim 4 in which the decorative elements have a periheral edge which is downwardly chamfered on the outside.

7. The combination of claim 1 in which said decorative elements are arranged on the concave body inner surface in edge-to-edge relation with no gaps therbetween.

8. The combination of claim 1 in which glue secures the discrete decorative elements to the decorative body concave inner surface.

9. A method for rendering a concave surface decorative and light-reflecting, comprising the steps of forming a plurality of discrete decorative elements; each of said elements having a convex underside for mounting on said concave surface and a flat or faceted upper side; and securing the decorative element undersides to said concave surface whereby said concave surface is faceted by means of the upper sides of said decorative elements.

10. A decorative light-reflecting concave surface made in accordance with the method of claim 9.

* * * * *